United States Patent [19]

Chen et al.

[11] 4,205,437

[45] Jun. 3, 1980

[54] CLEAN-OUT DEVICE FOR TWIN BLADE SHAVING UNIT

[75] Inventors: Evan N. Chen, Fairfield; Bryan J. Goddard, North Branford, both of Conn.

[73] Assignee: Warner-Lambert Company, Morris Plains, N.J.

[21] Appl. No.: 16,770

[22] Filed: Mar. 2, 1979

Related U.S. Application Data

[63] Continuation of Ser. No. 886,710, Mar. 15, 1978, abandoned.

[51] Int. Cl.[2] ..... B26B 21/22

[52] U.S. Cl. ..... 30/41

[58] Field of Search ..... 30/41, 41.5

[56] References Cited

U.S. PATENT DOCUMENTS

| | | | |
|---|---|---|---|
| 2,399,552 | 4/1946 | Larson | 30/41 |
| 3,972,114 | 8/1976 | Chao et al. | 30/41 |
| 4,047,296 | 9/1977 | Ishida et al. | 30/41 |

FOREIGN PATENT DOCUMENTS

| | | | |
|---|---|---|---|
| 51-70692 | 4/1976 | Japan | 30/41 |
| 52-22791 | 2/1977 | Japan | 30/41 |

*Primary Examiner*—Jimmy C. Peters

*Attorney, Agent, or Firm*—Jeremiah J. Duggan; Stephen A. Schneeberger

[57] ABSTRACT

An improved twin blade razor system having a unitary member positioned between the pair of blades for both spacing the blades and ejecting shaving debris from that space. The unitary member, which may conveniently be of injection molded plastic, includes a spacer portion, an ejector portion, and biasing means connecting the ejector portion and the spacer portion for biasing the ejector portion to a normally retracted position relative to the blades and spacer. The ejector portion extends across in front of but is substantially discontinuous behind the spacer portion, resulting in a compact front-to-rear configuration for the unitary member which may be housed in a relatively compact twin blade system. The ejector portion is manually displaceable to an advanced ejecting position. The biasing portion may be one or more beam springs connected and configured to reduce distortion and/or stressing of the relatively moving portions of the member during actuation.

9 Claims, 6 Drawing Figures

CLEAN-OUT DEVICE FOR TWIN BLADE SHAVING UNIT

This is a continuation of application Ser. No. 886,710 filed Mar. 15, 1978, now abandoned.

BACKGROUND OF THE INVENTION

The present invention relates generally to a shaving blade unit for use in or forming part of safety razors and, more specifically, to a twin-bladed shaving unit having means for ejecting debris including shaved hair particles deposited in and clogging the space between the leading and following cutting edges provided by the pair of blades.

Twin-bladed safety razors are believed to possess desirable shaving characteristics. Such razors include two blade elements disposed parallel to each other in spaced relation and each having a cutting edge such that the pair provide leading and following cutting edges so that both cutting edges are successively active with respect to the hair elements or whiskers being cut during a shaving stroke.

While shaving with a twin-bladed safety razor, various types of debris such as shaved hair and whisker particles and shaving lather and gradually deposited in and thus clog the space between the leading and following cutting edges of the twin-bladed shaving unit. These deposits may adversely affect the shaving characteristics of the razor so that it customarily must be removed at some appropriate time or times before, during or after shaving. Until recently, most prior art twin-bladed shaving units did not in general include a means for ejecting the shaving debris and, accordingly, removal of that debris had to be accomplished by relatively difficult and time-consuming techniques, such as washing, for example.

One effort directed to overcoming the above problem is disclosed in U.S. Pat. No. 3,972,114 to Chao et al for Self-Cleaning Mechanism for Twin Blade Razors issued Aug. 3, 1976, wherein a self-cleaning mechanism is arranged between the blades of a twin blade razor whereby the area between the blades can be made clean and free of debris by movement of the cleaning mechanism with a person's fingers. This cleaning mechanism, however, is operated by manual reciprocatory motion in a direction parallel to the blade edges. Teeth on the forward edge of the mechanism have inclined surfaces for forwardly displacing debris from between the blades; however, such arrangement is less than totally efficient in removing debris due to the limited number of teeth, the incline angle of the teeth, and the limited range of lateral displacement of the cleaning mechanism.

In U.S. Application Ser. No. 849,586 filed Nov. 8, 1977, by F. A. Ferraro for Two-Edge Shaving Blade Unit Having Debris-Removing Means, there is disclosed an improved mechanism for removing debris from between spaced blades. More specifically an elongated spacer member serves to maintain the pair of blades in spaced relation and a separate ejector member with an opening loosely fitting around the spacer is displaceable between a forward or advanced and a rearward or retracted position for clearing debris.

The U.S. Pat. No. 4,047,296 to Ishida et al for Two-Edge Shaving Blade Unit Having Anti-Clogging Means issued Sept. 13, 1977, discloses a clean-out mechanism of the same general type disclosed in the aforementioned Ferraro application, Ser. No. 849,586, and additionally includes biasing means for normally retaining the ejector in its retracted position. However, the spacer, the ejector, and the biasing means comprise three separate elements which serve to complicate the assembly of the shaving unit.

More recently, in U.S. application Ser. No. 866,127 filed Dec. 30, 1977, now abandoned, by Chen et al for Improved Clean-Out Mechanism For Twin Blade Shaving Unit, there is disclosed an improved clean-out mechanism having a unitary member which integrally comprises a spacer, an ejector and biasing means connecting the ejector and spacer for biasing the ejector to a normally retracted position relative to the blades and spacer.

The immediately aforementioned clean-out mechanism was particularly suited for use in the general type of twin-blade cartridge disclosed in U.S. Pat. No. 3,890,704 by Ferraro for Razor Blade Cartridge issued June 24, 1975, which cartridge has been widely used for nearly ten years. However, recent trends in shaving cartridges have emphasized a more compact design in which the height (thickness), length (side-to-side) and depth (width, front-to-rear) have been significantly reduced. These new cartridge geometries particularly limit the depth, or width, available for housing a clean-out member, yet aesthetic and other considerations generally dictate that most of the member be housed within the cartridge.

Accordingly, it is a primary object of the present invention to provide an improved twin blade razor unit including an improved unitary spacer and clean-out device of the general type disclosed in the aforementioned U.S. application Ser. No. 866,127 of Chen et al and particularly suited for compact razor cartridges.

It is a further object of the invention to provide an improved unitary spacer and clean-out device for twin blade razor cartridges, which device has reduced initial cost and/or affords increased rate of assembly during manufacture.

SUMMARY OF THE INVENTION

In accordance with the present invention, there is provided an improved razor blade system of the type employing a pair of spaced razor blades with cutting edges on the forward edges thereof fixedly positioned between seat and cap portions. More specifically, the improvement comprises unitary spacer and ejecting means comprised of a spacer portion fixed between the seat and cap portions, an ejector portion extending across in front of but being substantially discontinuous behind the spacer portion for displacement between advanced and retracted positions relative thereto, and a biasing portion fixed to the spacer portion and the ejector portion for normally retaining the ejector portion in the relatively retracted position, the ejector portion being manually displaced to the advanced position for ejecting shaved hair. The ejector and biasing portions may be of slightly lesser thickness between the blades than the spacer portion. The ejector portion may include guide portions extending beside the spacer portion.

In a preferred embodiment, the spacer portion comprises two laterally spaced and laterally elongated segments each connected to the ejector portion by a respective beam spring so configured and connected to the ejector portion and respective spacer segments as to reduce distortion during displacement of the ejector portion. A push-tab mounted on a rearwardly extending, centrally positioned segment of the ejector portion extends above and below the segment to facilitate handling during manufacture of a razor blade system.

DESCRIPTION OF PREFERRED EMBODIMENTS

Figure 1:
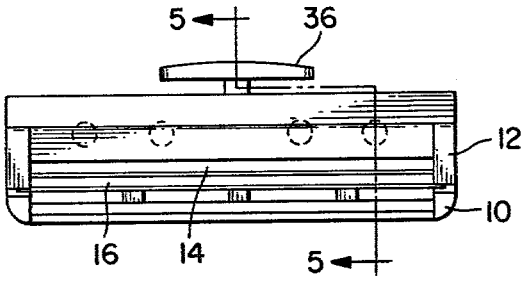
FIG. 1 is a plan view of an embodiment of a twin blade shaving unit in accordance with the invention.
Figure 2:
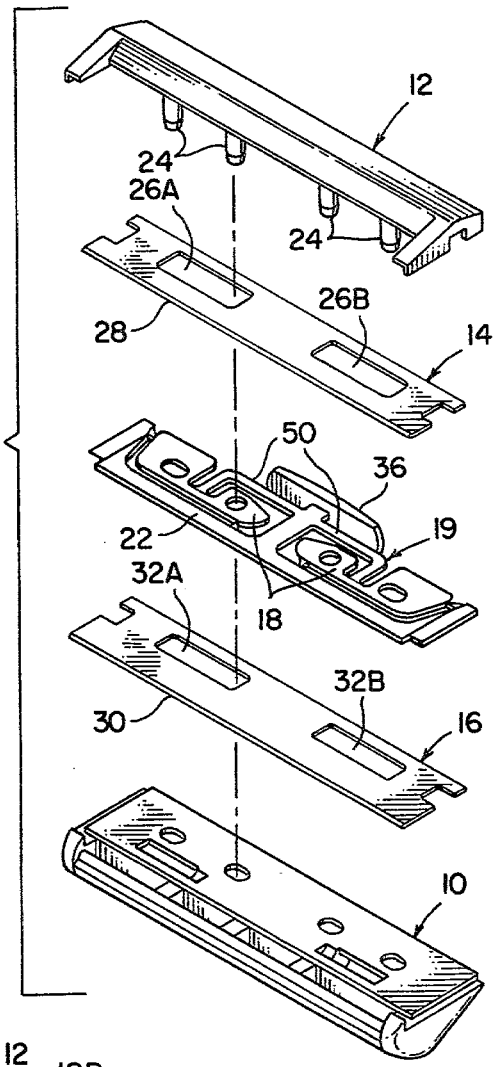
FIG. 2 is an exploded view of the unit shown in FIG. 1.
Figure 4:
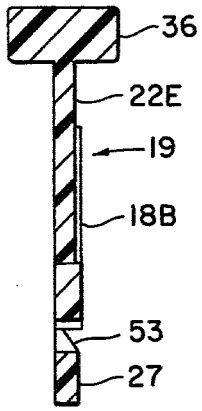
FIG. 4 is a sectional view taken along the line 4—4 in FIG. 3.
Figure 5:
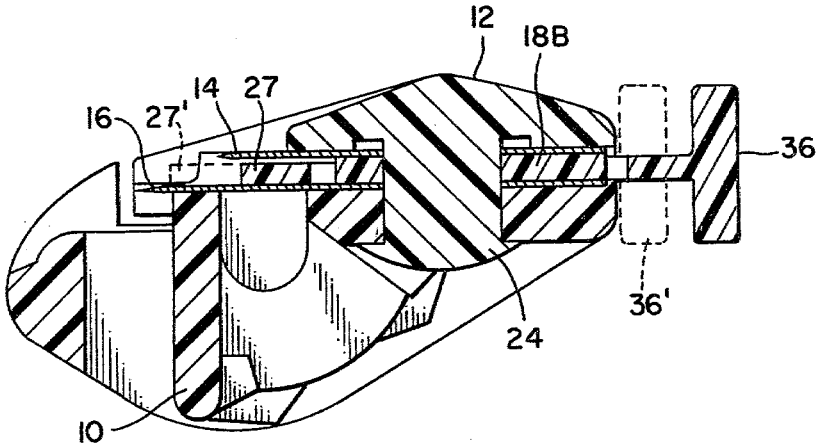
FIG. 5 is a sectional view taken along the line 5—5 in FIG. 1.
Figure 6:
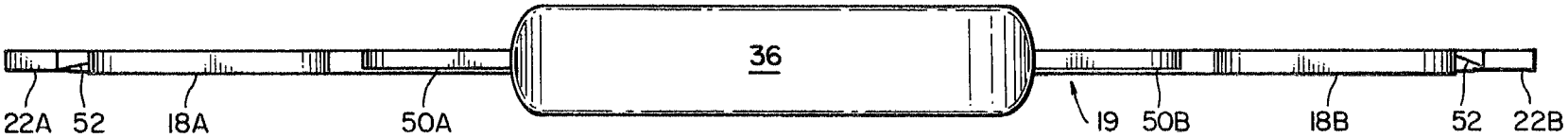
FIG. 6 is a rear elevation view of the member of FIG. 3.

Referring to FIGS. 1, 2 and 5, the twin blade shaving unit or system illustrated includes a seat portion 10 and a cap portion 12, both of which may be of plastic material. An upper or cap blade element 14 and a lower or seat blade element 16 are fixed between the platform and cap portions 10, 12 in a parallel and spaced relation with the one-piece or unitary (i.e., integrally formed) spacing and clean-out device 19 of the invention interposed therebetween. The cap 12, the seat 10, and the upper and lower blade elements 14, 16 are of the general type illustrated and described in the aforementioned U.S. Pat. No. 3,890,704 to Ferraro, with the exceptions that the resulting unit is relatively more compact and may include means for pivotable mounting to a razor handle. Whereas most twin blade shaving units have typically been about 0.480 inch in depth, and the unit illustrated in the aforementioned application Ser. No. 866,127 being even wider than that, the present unit in accordance with recent trends has a width of only about 0.40–0.41 inch parallel the plane of blades 14, 16, exclusive of a rearward extension attributable to a push tab 36 of device 19.

As partially illustrated in FIGS. 2 and 5, the cap 12 has four posts 24 projecting from its inner wall surface, the lateral spacing between the first and second and the third and fourth posts being the same and less than that between the second and third posts. The posts 24 serve as members for fixing in position the upper and lower blade elements 14, 16 and the spacer portion 18 of the unitary spacing and clean-out device 19. FIG. 2 shows the upper blade element 14 formed toward its opposite lateral end portions with laterally extending slots 26A and 26B respectively. The upper blade element 14 is disposed with its upper surface contacting the inner wall surface of cap 12 and with its cutting edge 28 directed forwardly, and is fixed in position with its slots 26A, 26B fitted onto respective equally spaced pairs of posts 24.

The lower blade element 16 of FIG. 2 is disposed between the seat and cap 10, 12 respectively with its lower surface contacting the inner wall surface of the seat 10, and with its cutting edge 30 directed forwardly. Lower blade 16 is slightly wider than the upper blade 14 and the slots 32A and 32B of the lower blade 16 are positioned slightly more rearward relative to cutting edge 30 than are slots 26A, 26B relative to cutting edge 28. For assembly, slots 32A, 32B are fitted onto respective equally spaced pairs of posts 24 of cap 12. Consequently, when the upper and lower blade elements 14, 16 are assembled, the cutting edge 30 of the lower blade 16 is slightly advanced as compared with the cutting edge 28 of the upper blade element 14, thus providing the leading and following cutting edges, respectively.

Referring now to FIGS. 2, 3, 4 and 6, the unitary spacing and clean-out member 19 is comprised of a spacer portion 18, an ejector portion 22, and interconnecting biasing means 50. The combination spacer-ejector member 19 is formed of a material which is preferably easy and inexpensive to mass-produce, yet readily resists the high temperatures of shaving rinse water and the chemical attack of various toiletries and possesses high strain resistance and the capacity to act as a spring in then sections. Applicants have found high temperature thermoplastics such as acrylic-butyl styrene (e.g., CYCOLAC-T by Borg-Warner) to be particularly satisfactory. Of course, other materials such as the 400 series of stainless steels and 4000, 5000 and 6000 series of aluminum alloys might also be generally suitable where increased rigidity or the like is required, but would possess certain obvious limitations. The plastic member 19 of the illustrated embodiment is conveniently formed by injection molding.

The geometry of the combined spacer and clean-out member 19 is now considered in greater detail. The spacer portion 18 is comprised of a pair of symmetrically identical, thin, laterally spaced and laterally elongated spacer segments 18A and 18B respectively. The lateral elongation of each spacer segment 18A, 18B is sufficient for the formation of a pair of post holes 25A, 25B respectively therein. Post holes 25A, 25B are positioned and sized for a respective pair of posts 24 to pass therethrough and fixedly position the respective spacer segments relative to cap 12 and seat 10. The thickness of spacer segments 18A, 18B is selected as the desired spacing between upper end lower blades 14, 16 thereby to establish such spacing when positioned in mutual contact therebetween. Typically, the thickness of the spacer portion 18 will be about 0.020 inch.

The ejector portion 22 is a substantially flat and rigid E-shaped member having a forward ejector bar 27 connected by three spaced arms 22A, 22E, and 22B respectively. Ejector bar 27 extends across in front of spacer portion 18 from beyond one end to beyond the opposite end thereof in normally spaced relation therewith. Opposite end arms 22A and 22B extend rearwardly from ejector bar 27 laterally outward of the opposite ends of spacer portion 18. Middle arm 22E extends rearwardly from the middle of ejector bar 27, passing between the spaced spacer segments 18A, 18B. Middle arm 22E is preferably longer than end arms 22A, 22B and mounts push tab 36 at its rearward end. Ejector end arms 22A and 22B are sized and configured to comprise guide or support elements for maintaining alignment of ejector portion 22 during actuation, and additionally prevent shaving debris from lodging behind the ends of ejector bar 27. The end arms 22A, 22B are somewhat outboard of the ends of ejector bar 27 and are offset rearwardly to ensure full forward actuation of ejector bar 27. The guide element portions of end arms 22A, 22B are positioned substantially at and slightly outboard of the ends of cap and seat blades 14, 16 and thus are slightly relieved in the vertical direction to avoid interfering contact with any small burrs which may exist on the blade ends resulting from their manufacturing process.

The biasing means 50 connecting the spacer portion 18 with the ejector portion 22 is comprised of beam springs 50A and 50B connecting the ejector portion 22 with spacer segments 18A and 18B respectively. Like the ejector portion 22, beam springs 50A, 50B are slightly thinner than spacer segments 18A, 18B to allow their relative forward and back movement between blades 14, 16. Typically, both the ejector portion 22 and beam springs 50A and 50B are about 0.018 inch thick. It will be appreciated, however, that in cartridges of typical construction, such reduction in thickness may not be necessary due to accumulated tolerances. Springs 50A, 50B are about 0.035 inch wide along their length.

Figure 3:
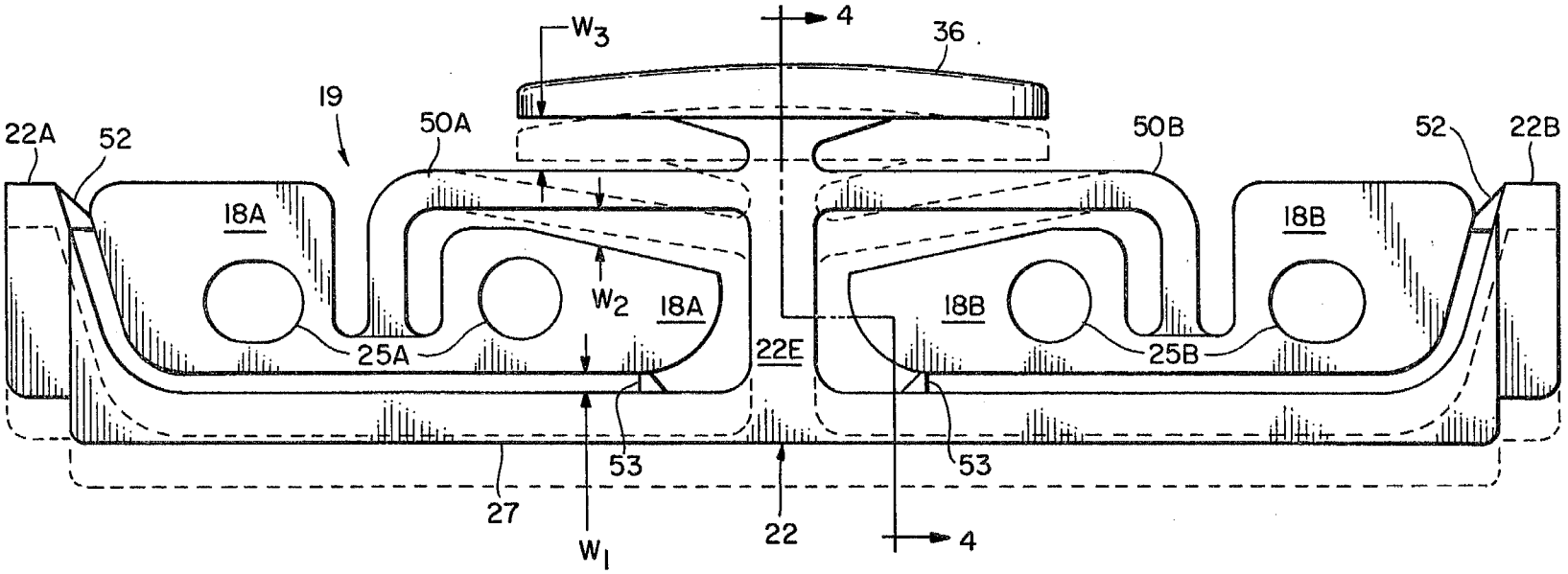
FIG. 3 is an enlarged plan view of the unitary spacer and ejector member of FIG. 2.

In the illustrated embodiment, beam springs 50A, 50B each have a so-called dogleg shape, one leg-segment being anchored at an end through integral connection with a respective spacer segment 18A, 18B in a forwardly recessed notch in the rear midsection thereof between a respective hole-pair 25A, 25B and extending rearwardly therefrom and the other leg-segment extending at about 90° therefrom laterally inward behind the respective spacer segment and being anchored at its end by integral connection with ejector middle arm 22E just forward of push tab 36. The rearwardly extending portion of each spring 50A, 50B is capable of a small angular deflection or pivoting toward the respective laterally-inward end of spacer segment 18A, 18B when the ejector portion 22 is advanced, thereby to allow substantially linear movement of the ejector-connected end of the respective spring as its deflects or pivots angularly about the intersection of the two portions of the dogleg during the advance. The dotted-line position of springs 50A, 50B in FIG. 3 illustrates these angular deflections of the respective portions of the dogleg of the spring, revealing that the ejector-connected end of the spring moves substantially normal to the cutting edges 28, 30. This action is required if ejector portion 22 is to move forward and back.

This construction in which the ejector portion 22 is essentially discontinuous or nonexistant rearwardly of spacer portion 18 is in contrast with the embodiment illustrated in the aforementioned U.S. application Ser. No. 866,127 in which the ejector portion included a laterally or transversely extending, continuous segment located to the rear of the spacer portion and connected at its ends to arms 22A, 22B. The present construction significantly reduces the front-to-back depth of the major portion of member 19 whereby substantially all of it but push tab 36 may be housed within the compact unit defined by cap and seat 12, 16. More specifically, the laterally extending rear edge of each spring 50A, 50B is only slightly (i.e., less than about 0.01 inch) behind the rearmost edges of respective spacer segments 18A, 18B and respective end arms 22A, 22B.

Referring further to FIG. 3, the ejector portion 22 of member 19 in its relatively retracted position to which it is normally biased is shown in solid-line form. In that configuration, the spacing normal to cutting edges 28, 30 between the ejector bar 27 and the spacer portion 18 is denoted $W_1$ and is typically 0.017 inch. The spacing $W_2$ between spacer portion 18 and the laterally extending portions of springs 50A, 50B varies between about 0.020 inch adjacent the 90° bend in the springs to about 0.060 inch near the junction of the springs with ejector middle arm 22E, for accommodating the forward angular displacement of the respective springs during actuation. The increase in spacing is provided by a forward taper to the rear side of spacer segments 18A, 18B from about the inboard holes of hole-pairs 25A, 25B to the inner ends of the respective spacer segments.

The spacing $W_3$ between the forward face of push tab 36 and the rear side or edge of springs 50A, 50B is about 0.050 inch. The rear edge of springs 50A, 50B is substantially flush with the rear edges of cap and seat 12, 10 respectively and thus, forward displacement of ejector portion 18 is step-limited by contact of push tab 36 with the rear edges of the cap and seat.

Further, the lateral length L between center arm 22E of ejector portion 22 and the inboard end of a respective breakaway tab 52 may be 0.615 inch and is sufficiently greater than the lateral length $L_1$ of a spacer segment 18A, 18B to facilitate relative fore and aft movement of ejecting portion 22.

Side breakaway tabs 52 and front breakaway tabs 53 are integrally formed with and connect ejector portion 22 with spacer portion 18 to stabilize these elements during assembly of the shaving unit. The breakaway tabs 52, 53 are quite thin at their point of connection with spacers 18A, 18B (see FIG. 4). Upon completion of assembly, a forwardly directed manual or mechanical force is applied to the push tab 36 sufficient to cause tabs 52 and 53 to break away from their engagement with spacer portions 18, thereby and thereafter permitting fore and aft displacement of ejector portion 22 relative to spacer portion 18.

According to one aspect of the invention, the push tab 36 extends about 0.042 inch both above and below the rear end of ejector middle arm 22E to which it is perpendicularly joined, thereby to provide symmetrical overhangs or flanges which may serve to orient the member 19 as it is delivered to an assembly station, as by a vibratory feeder. Such feeders require a flange of the member to overhang a shoulder of the feeder if it is to be considered "properly oriented" for further feed. Because of the symmetry of the spacer and clean-out member 19, and the pair of oppositely extending flanges provided by push tab 36, the member will be passed if in either of two opposite orientations about an axis of symmetry formed by the center line of middle arm 22E. This increased feed rate (reduced "rejection" rate) enhances assembly of the overall twin blade unit.

The dotted-line section of FIGS. 3 and 5 illustrates ejector portion 22 displaced from its normally retracted position partway to its advanced position. Typically the magnitude of displacement between the retracted and advanced positions is about 0.050 inch and is determined by push tab 36 contacting the rear surfaces of cap and seat 12, 10 respectively. The primed reference numerals refer to the corresponding elements displaced to the relatively advanced position. When fully advanced, the leading edge of ejector bar 27 is positioned forwardly of the upper or following cutting edge 28 to clear and expose debris deposited between the blades for simple rinsing away with a stream of water. The thickness of ejector bar 27, being nearly that of spacer portion 18, is sufficient to sweep debris from substantially the entire space between blades 14, 16 when manually actuated. When the actuating force is released from push tab 36, beam springs 50A, 50B act to return ejector portion 22 to its normally retracted position entirely to the rear of cutting edges 28 and 30, whereupon shaving may be resumed.

The various curves and corners in the aforedescribed spacer and clean-out member 19 are contoured to permit easy and reliable operation without overstressing any portion of it. The resulting member is particularly suited to use with compact twin blade cartridge designs, though it is also applicable to the older and somewhat larger twin blade cartridge as well.

The invention may be embodied in yet other specific forms without departing from the spirit or essential characteristics thereof. For instance, the beam springs might be positioned forwardly rather than rearwardly of the spacer portion if other geometry permits. Also, the ejector end arms may be substantially shortened and the spacer segments lengthened outwardly therebehind if increased spacer area is desired. Thus, the present embodiments are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a razor blade system including a seat portion, a cap portion, a pair of razor blades with cutting edges on the forward edges thereof fixedly positioned between the seat and cap portions, and unitary means interposed between said pair of razor blades for maintaining said blades in spaced relation to each other and for ejecting shaving debris from therebetween, said unitary spacing and ejecting means comprising a spacer portion fixed between said seat and cap portions, an ejector portion for forward and rearward displacement thereof relative to said spacer portion between advanced and retracted positions respectively, and a biasing portion fixed to said spacer portion and said ejector portion for normally retaining said ejector portion in said relatively retracted position, displacement of said ejector portion to said advanced position serving to eject shaving debris, the improvement wherein:

said ejector portion extends substantially entirely across said spacer portion forwardly thereof and is substantially discontinuous rearwardly of said spacer portion.

2. The razor blade system of claim 1 wherein said spacer portion comprises two laterally spaced segments, said biasing portion comprises two biasing segments and said ejector portion comprises an ejector bar extending continuously across said spacer segments forwardly thereof and an arm extending rearwardly between said spacer segments from substantially the middle of said ejector bar for receiving a manual actuating force.

3. The razor blade system of claim 2 wherein said biasing portion comprises a pair of biasing segments each being anchored to a respective one of said spacer segments and in common to said ejector middle arm.

4. The razor blade system of claim 3 wherein each said biasing segment comprises a resilient beam spring having a substantially 90° dogleg shape, one end of each spring being integrally joined to a respective spacer segment in a forwardly recessed notch in the rear side of said spacer segment, and the other end of each said spring being integrally connected to said ejector middle arm.

5. The razor blade system of claim 4 wherein each said spring joins said respective spacer segment intermediate the respective laterally outward and inward ends of said segment, and the rearward side of each spacer segment is forwardly inclined laterally inward of its juncture with a respective said spring thereby allowing forward angular displacement of said spring about said bend in said dogleg.

6. The razor blade system of claim 5 wherein the laterally extending rear edge of each said spring is less than about 0.01 inch rearward of the rearmost edge of the respective said spacer segment to which it is joined.

7. The razor blade system of claim 2 wherein said ejector portion additionally comprises a pair of end arms each connected to a respective opposite end of said ejector bar and extending rearwardly therefrom laterally outward of said respective spacer segments thereby to guide said ejector bar during advance and retraction.

8. The razor blade system of claim 2 wherein said ejector middle arm includes a push tab integrally joined to its rear end for receiving a manual actuating force, said push tab extending both above and below said ejector middle arm so as to provide symmetrical flanges for orienting said unitary spacing and ejecting means in either of two opposite directions during assembly.

9. The razor blade system of claim 2 wherein said unitary member is an ejection molding of high temperature thermoplastic.

* * * * *